United States Patent [19]

Kimura

[11] Patent Number: 4,481,761

[45] Date of Patent: Nov. 13, 1984

[54] PNEUMATIC YARN SPLICING METHOD AND APPARATUS

[75] Inventor: Hidetoshi Kimura, Kyoto, Japan

[73] Assignee: Murata Kikai Kabushiki Kaisha, Kyoto, Japan

[21] Appl. No.: 438,254

[22] Filed: Nov. 1, 1982

[30] Foreign Application Priority Data

Nov. 2, 1981 [JP] Japan ..... 56-175894

[51] Int. Cl.[3] ..... D01H 15/00

[52] U.S. Cl. ..... 57/22; 57/261

[58] Field of Search ..... 57/22, 261, 262, 263

[56] References Cited

U.S. PATENT DOCUMENTS 3,487,618 1/1970 Arguelles ..... 57/22
4,263,775 4/1981 Mima ..... 57/261 X
4,292,796 10/1981 Mima ..... 57/261 X
4,397,137 8/1983 Davies et al. ..... 57/22
4,397,140 8/1983 Sheehan ..... 57/22

*Primary Examiner*—Donald Watkins
*Attorney, Agent, or Firm*—Spensley Horn Jubas & Lubitz

[57] ABSTRACT

A pneumatic yarn splicing apparatus having a splicing member arranged in the central portion thereof. The splicing member comprises a yarn splicing hole of a cylindrical shape extending through the body of the splicing member, a slit extending along the splicing hole and two nozzles opened to the splicing hole in confronting relation. The two nozzles are so constructed that there is a time lag between the initiation of jetting at a first nozzle and the initiation of jetting at a second nozzle.

8 Claims, 23 Drawing Figures

PNEUMATIC YARN SPLICING METHOD AND APPARATUS

BACKGROUND OF THE INVENTION

In an automatic winder for spun yarns, for the splicing operation, there has heretofore been adopted in which a knot is formed by using a mechanical knotter. However, recently, there is often adopted a method in which splicing is effected by entangling fibers of yarn ends by using air. This method in advantageous in that no knot is formed, the post-treatment is facilitated and a product excellent in the appearance is obtained.

Such a yarn splicing apparatus has been proposed, for example, in U.S. Pat. No. 4,263,775. But, there is a problem how an air stream is caused to act on yarn ends on splicing so as to obtain a good joint.

SUMMARY OF THE INVENTION

The present invention relates to a construction of a splicing member of the pneumatic yarn splicing apparatus performing the splicing action and a method for applying an air jet in the splicing member.

It is a primary object of the present invention to obtain a joint having an excellent appearance and a high strength.

According to the present invention the splicing member arranged in the central portion of the yarn splicing apparatus comprises a yarn splicing hole of a cylindrical shape extending laterally therethrough, a slit extending along the splicing hole and two nozzles opened to the splicing hole in confronting relation. In the splicing operation, at first the jet stream from the nozzle opened toward the central portion of the splicing hole is applied to the lapped yarn ends and then the turning stream from the nozzle opened in the tangential direction is also applied to the yarn ends to accomplish the splicing.

DETAILED DESCRIPTION OF THE INVENTION

The present invention will now be described in detail with reference to embodiment illustrated in the accompanying drawings.

Figure 1:
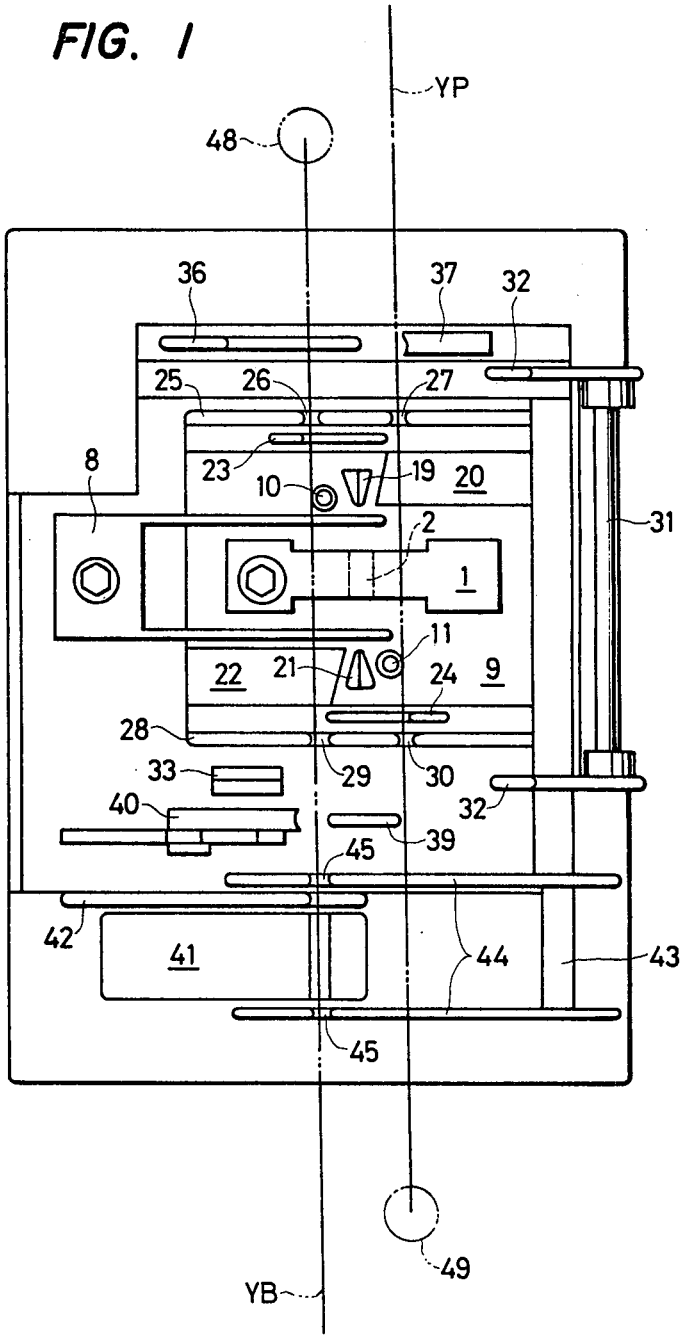
FIG. 1 is a front view showing the entire structure of the splicing apparatus.
Figure 5:
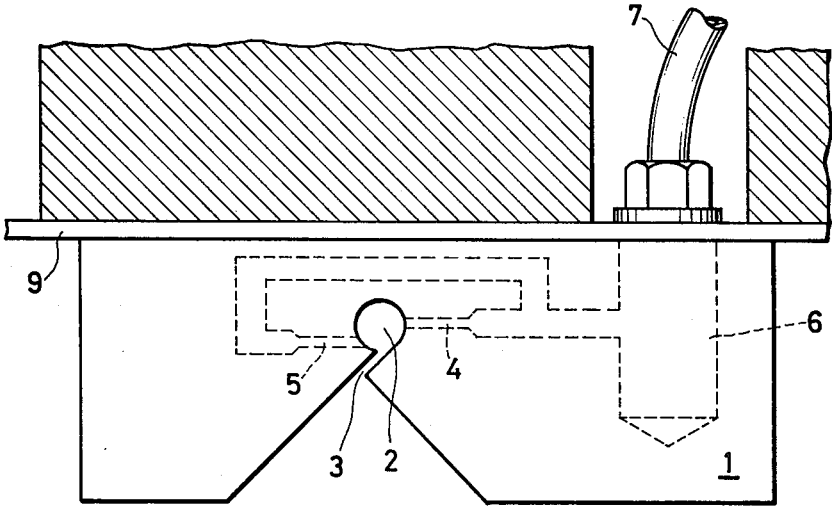
FIG. 5 is a plan view showing one embodiment of the splicing member.
Figure 6:
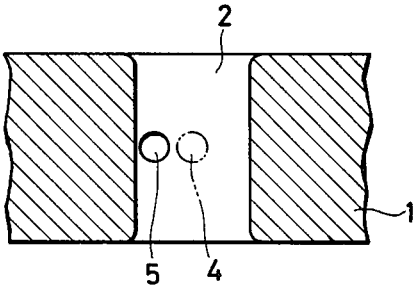
FIG. 6 is a view showing the sectional shape of the nozzle in FIG. 5.

FIG. 1 is a diagram of one embodiment of the splicing apparatus of the present invention, which illustrates the state where yarns YP and YB to be spliced are guided by suction pipes 49 and 48. A splicing member 1 is arranged in the central portion of the apparatus, and this splicing member 1 comprises, as shown in FIG. 5, a cylindrical splicing hole 2, a slit 3, a nozzle 5 opened tangentially to the splicing hole 2 and a nozzle 4 opened toward the center of the splicing hole 2. The nozzles 4 and 5 are communicated with a compressed air supply pipe 7 through an air introduction hole 6. The nozzles 4 and 5 have a circular section as shown in FIG. 6. A yarn pressing lever 8 is located on both the sides of the splicing member 1, and control nozzles 10 and 11 are opened through a bracket 9. Yarn guides 19, 20, 21 and 22 are attached to the bracket 9. Yarn cutting devices 23 and 24 are arranged on both the sides of the bracket 9 and fork guides 25 and 28 are provided at the outsides of the cutting devices. Yarn guide grooves 26, 27,29 and 30 are formed on the fork guides 25 and 28. A clamping device 35 comprising a turning lever 36 and a spring-supported clamping plate 37 is disposed above the fork guide 25 to hold the yarn YP at the splicing operation. A clamping device 38 comprising a lever 39 and a movable clamping plate 40 is disposed below the fork guide 28 to hold the yarn YB at the splicing operation. A pair of yarn handler levers 32 having a supporting shaft 31 are arranged on the alongside of the splicing apparatus to introduce the yarns YB and YP, guided to the front face of the splicing apparatus by suction pipes 48 and 49, into the splicing apparatus. Reference numeral 33 represents a stopper for the yarn handler lever 32. A detecting device 41 is disposed below the splicing apparatus to check the yarn YP before the splicing operation and the yarn YB after the splicing operation. The detecting device 41 is attached to a guide plate 42, and changeover levers 44 and 45 having a turning shaft 43 are arranged so that the detecting device 41 is put between the changeover levers 44 and 45.

Figure 7:
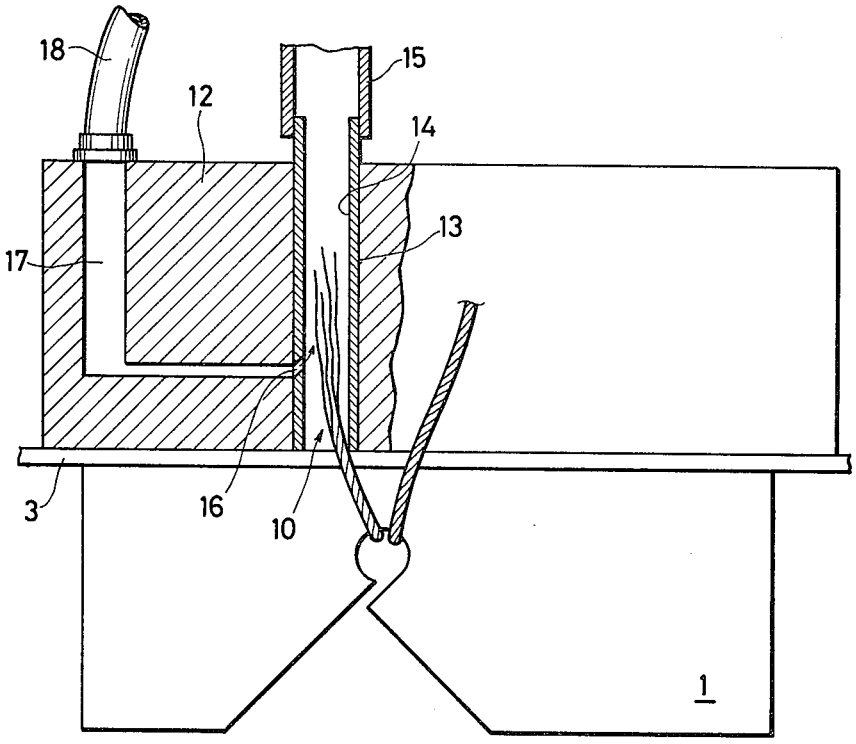
FIG. 7 is a diagram illustrating the operation state of the control nozzle.

As shown in FIG. 7, each of the control nozzles 10 and 11 comprises a nozzle pipe 14 slidably fitted in a nozzle hole 13 formed through a block 12. A jet hole 16 is formed in the nozzle pipe 14 in a manner inclined to the interior with respect to the inner diameter, and compressed air supplied from a compressed air supply pipe 18 through an induction hole 17 is jetted from this jet hole 16. The end portion of the nozzle pipe 14 is connected to a flexible pipe 15 connected to a suction pipe (not shown) to exert the function of sucking the cut yarn end into the nozzle pipe 14.

The operation of the splicing apparatus having the above-mentioned structure will now be described.

Figure 3:
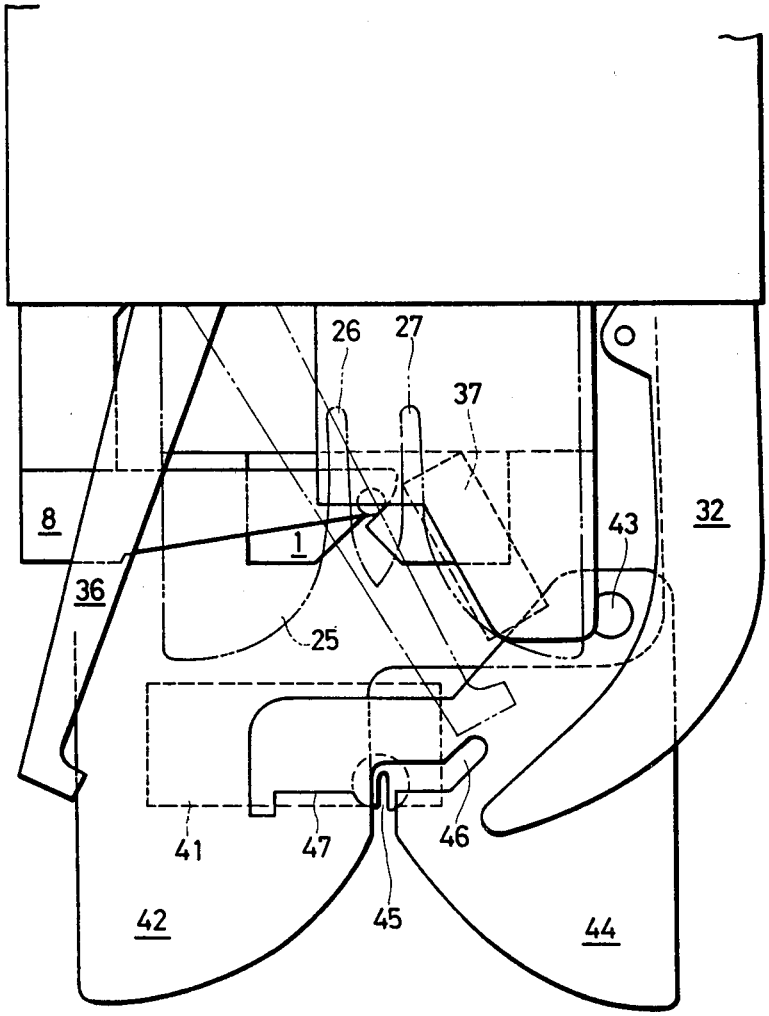
FIGS. 3 and 4 are plan views showing the main portion of the splicing apparatus shown in FIG. 1.
Figure 4:
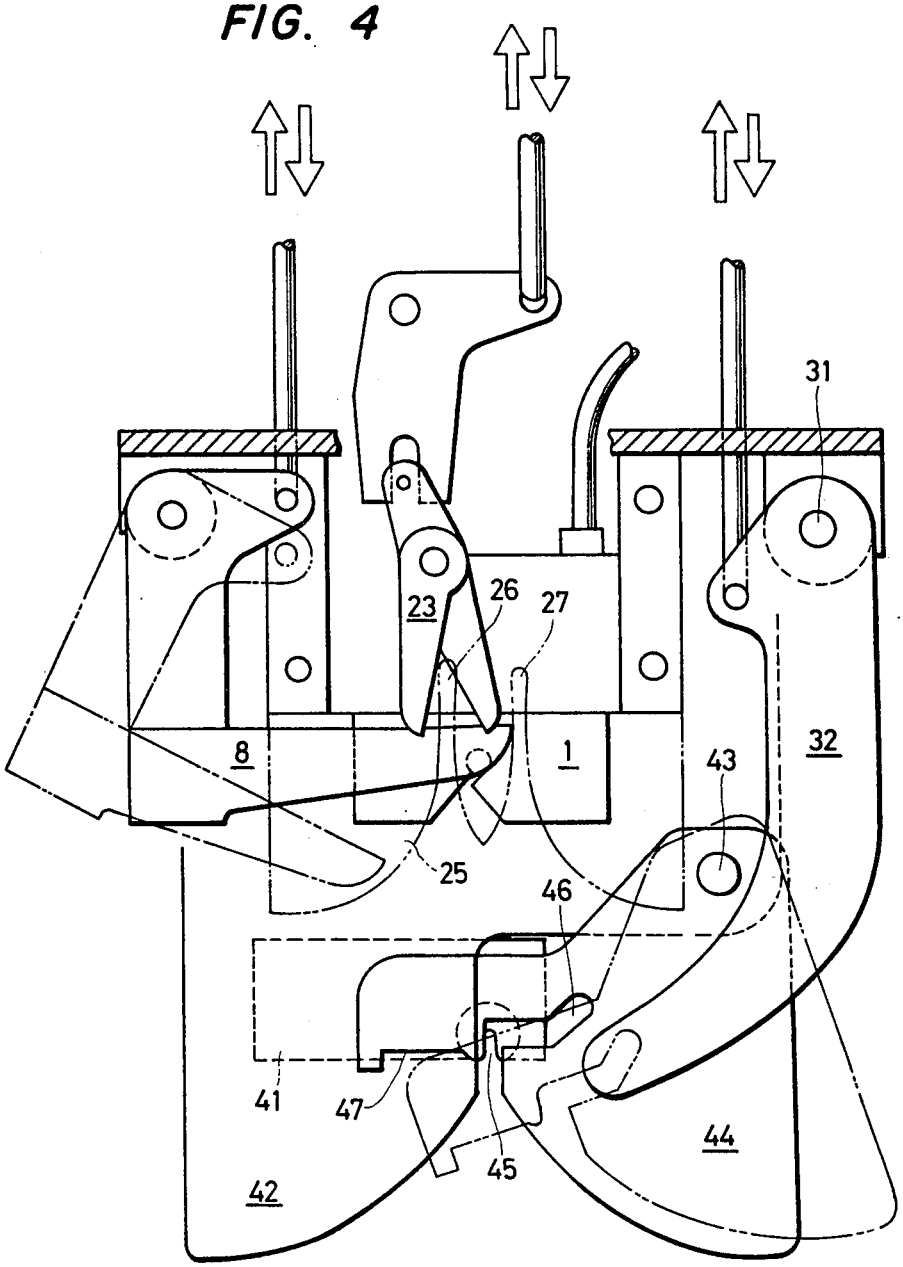

The yarn YP is guided from above the splicing apparatus by a suction pipe 49. At this time, the turning lever 36 and changeover lever 44 are located at positions indicated by solid lines in FIG. 3, and the yarn YP is guided into the guide groove 45 of the changeover lever 44 and is checked by the detecting device 41. A cutter is attached to the detecting device 41, and when the yarn YP is detected being defective by the detecting device 41, the cutter is actuated so that the yarn guiding operation by the yarn handler lever 32, described hereinafter, is not successfully performed and the splicing operation ends in failure. When the checking operation by the detecting device 41 is completed, the changeover lever 44 is moved to the position indicated by a chain line in FIG. 4, and the yarn YP is shifted to an escape groove 46 from the guide groove 45 and is separated from the detecting device 41. Simultaneously, the turning lever 36 is moved to the position indicated by a chain line in FIG. 3 to bring the yarn YP close to the clamping plate 37. Also the yarn pressing lever 8 is moved to the position indicated by a chain line in FIG. 4 to the position indicated by a solid line to prepare for the subsequent yarn guiding operation.

Figure 2:
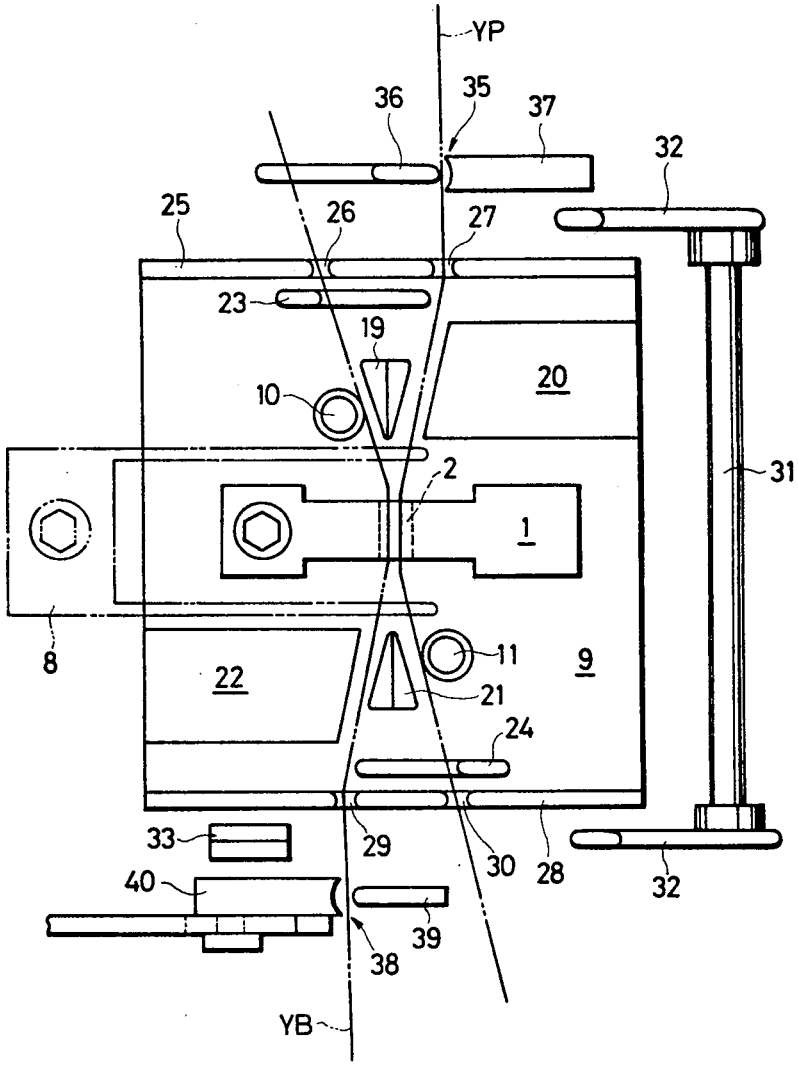
FIG. 2 is a front view showing the main portion of the splicing apparatus shown in FIG. 1.
Figure 8:
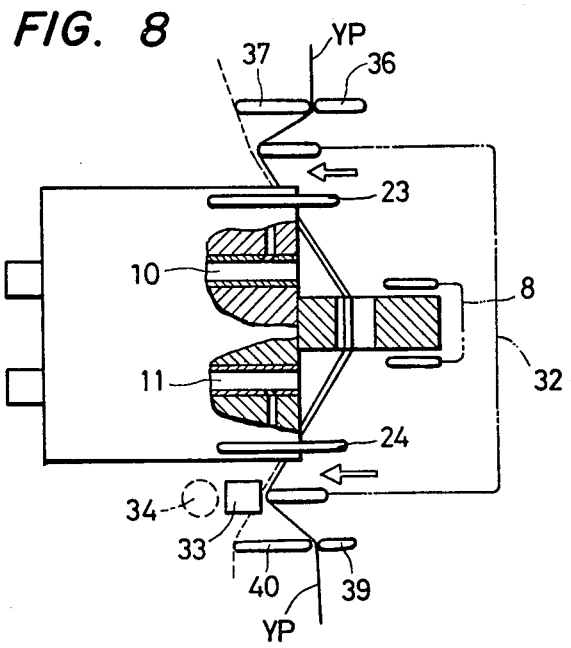
FIGS. 8 through 11 are side views illustrating the operation of the splicing apparatus.

Then, the suction pipe 48 guides the yarn YB from below the splicing apparatus. The yarn YB passes on the left side of the turning lever 36 located at the position indicated by a chain line in FIG. 3 while having contact with a hook portion 47 of the changeover lever 44. The state of the yarns YP and YB at this time is illustrated in FIG. 1. Then, the yarn handler lever 32 is turned to the position impinging against the stopper 33 to guide the yarns YP and YB into the splicing apparatus. Simultaneously, the yarn pressing lever 8 is returned to the position indicated by a solid line in FIG. 4 to assist the above operation. The state at this time is illustrated in FIGS. 2 and 8. The yarn YP passes between the turning lever 36 and the clamping plate 37 and through the guide groove 27 of the fork guide 25, and the yarn YP is guided to the guide groove 30 of the fork guide 28 through the groove portion between the yarn guides 19 and 20, the splicing hole 2 and the yarn cutting device 24. The yarn YB passes between the movable clamping plate 40 and the lever 39 and through the guide groove 29 of the fork guide 28 and is guided to the guide groove 26 of the fork guides 25 through the groove portion between the yarn guides 21 and 22, the splicing hole 2 and the yarn cutting device 33.

Figure 9:
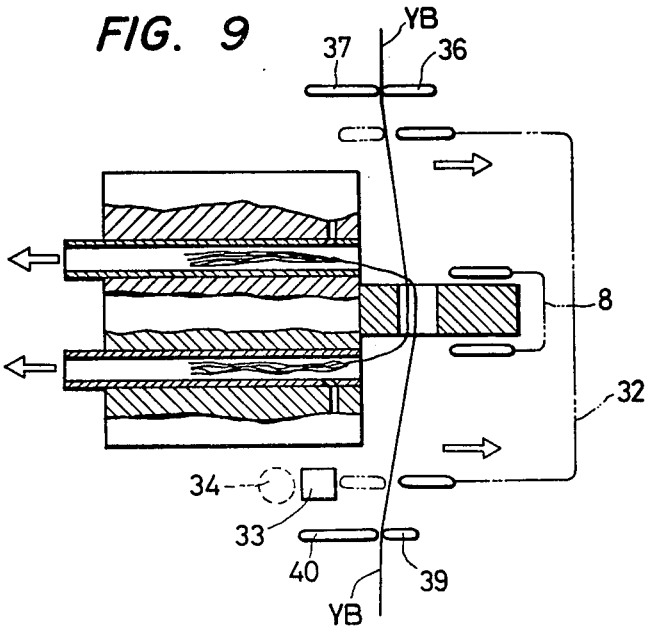
Figure 10:
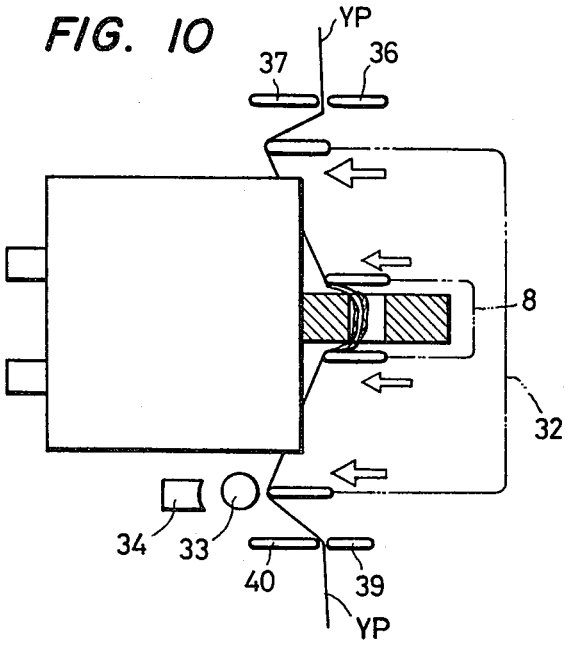

The turning lever 36 is pressed to the clamping plate 37 to hold the yarn YP therebetween, and simultaneously, the movable clamping plate 40 is pressed to the lever 39 to hold the yarn YB therebetween. Then, the yarn cutting devices 23 and 24 are actuated. Almost at the same time, the control nozzles 10 and 11 are actuated to such both the yarn ends YB and YP. Referring to FIG. 7, the sucking effect due to the vacuum of the flexible pipe is exerted and compressed air supplied through the air introduction hole 17 from the jet hole 16 is jetted. The compressed air jetted from the jet hole 16 causes a swirling stream directed to the interior in the nozzle pipe 14. By this swirling stream, the yarn ends in the nozzle pipe 14 are untwisted and parts of fibers of the yarn ends are blown away, whereby yarn ends having a brush-like shape suitable for the splicing operation can be formed. At this time, as shown in FIG.9, the yarn handler lever 32 is slightly retreated to further feed the yarns YP and YB to the interior in the nozzle pipe 14.

Figure 11:
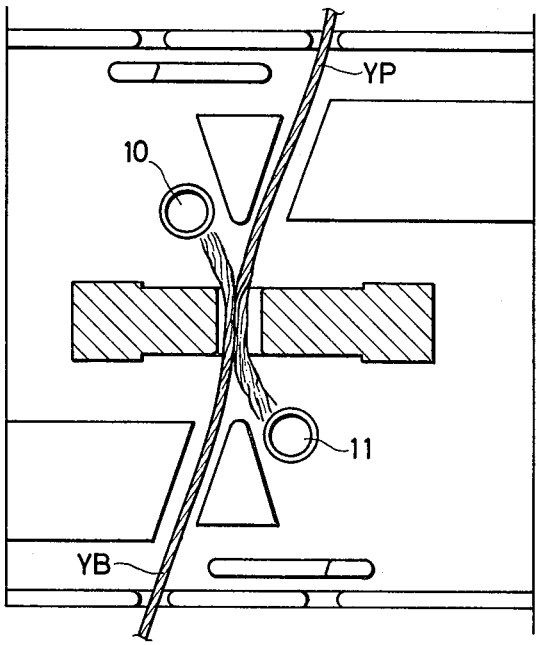
Figure 12:
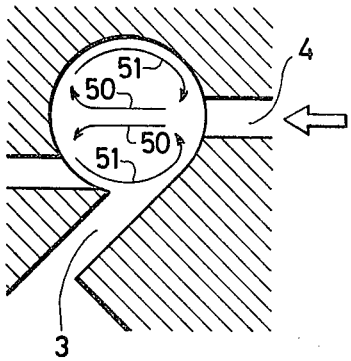
FIGS. 12 through 15 are diagrams showing jet streams in the splicing hole.

Then, as shown in FIG. 12, the yarn handler lever 32 is advanced to draw out the yarns YP and YB from the nozzle pipe 14, and the yarn pressing lever 8 is advanced to arrange the untwisted yarn ends YP and YB in the interior portion in the splicing hole 2. At this time, the tops of both the yarn ends YP and YB are located in the vicinity of the end faces of the control nozzles 10 and 11 as shown in FIG. 11 and slacking of the yarns is prevented under the action of the control nozzle 10 and 11. Before the yarn handler lever 32 is advanced, the stopper 33 is moved, and the yarn handler lever 32 is stopped by a position-changeable stopper 34 located behind. This stopper 34 exerts a function of changing the take-out quantities of both the yarn ends YP and YB from the nozzle pipe 14 by changing the stopping position of the yarn handler lever 32 to change the length of the lap portion of both the yarn ends YP and YB, that is, the length of the joint.

Figure 13:
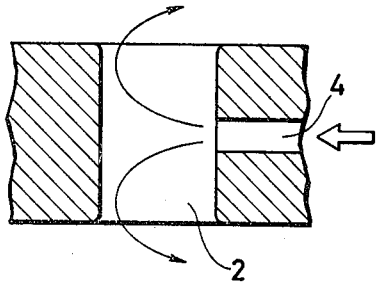
Figure 14:
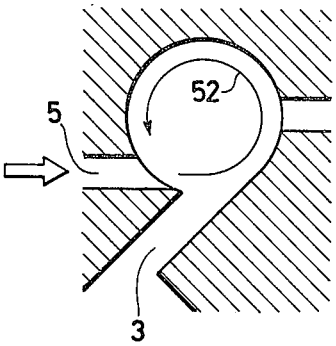
Figure 15:
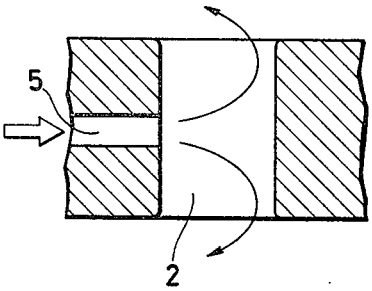

Then, the splicing operation is performed in the splicing hole by compressed air. Since the length of the passage extended from the air introduction hole 6 to the nozzle 5 is longer than the length of the passage extended from the air introduction hole 6 to the nozzle 4, there is produced a time lag between the initiation of jetting at the nozzle 4 and the initiation of jetting at the nozzle 5. Namely, only the nozzle 4 is first operated, and then, both the nozzles 4 and 5 are operated. The initial stage where only the nozzle 4 is operated is called "step A" and the subsequent step where both the nozzle 4 and 5 are operated is called "step B". The air stream formed in the splicing hole 2 by the nozzle 4 includes, as shown in FIG. 12, a direct stream 50 crossing the splicing hole 2 and a circular stream 51, and the air stream is discharged outside from both the open end faces of the splicing hole 2 as shown in FIG. 13. The air stream formed in the splicing hole 2 by the nozzle 5 is a turning stream 52 as shown in FIG. 14, and the air stream is discharged outside from both the open end faces of the splicing hole 2 as shown in FIG. 15.

Figure 16:
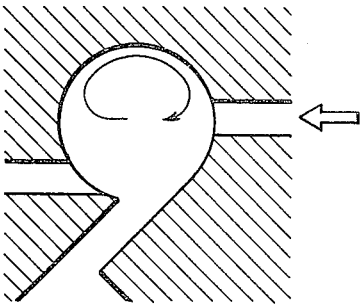
FIGS. 16 and 17 are diagrams showing movements of the yarn in the splicing hole.
Figure 17:
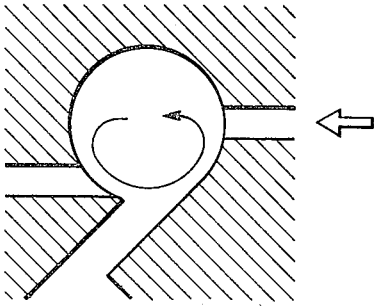

At the step A, if the circular stream 51 arrives at both the yarns YP and YB arranged and lapped in the interior of the splicing hole 2 as shown in FIG. 11, by the action of the circular stream, initial entanglement is caused among fibers of the contact portion of both the yarns YP and YB. Then, both the yarns YP and YB are integrated and are moved in the splicing hole 2 by the air streams. The movements of the yarns include those shown in FIG. 16 or 17 or combinations of movements shown in FIGS. 16 and 17. During these movements, especially under exposure to the direct stream 50, stirring of fibers of both the yarns YP and YB are advanced and strong entanglement is obtained. The tops of both the yarn ends which have been placed under the action of the nozzle pipes 14 before the splicing operation are entangled with each other during these movements and are released from the action of the nozzle pipes 14.

At the subsequent step B, jetting from the nozzle 5 tangentially opened is initiated, and the influence of the turning stream 52 from the nozzle 5 becomes large and both the yarn ends YP and YB are turned by the turning stream 52. At this time, entanglement of fibers in the surface portions of both the yarn ends YP and YB is promoted by the friction with the inner wall of the splicing hole 2 and the rotation of the turning air stream, and the tops of both the yarn ends YP and YB located on the outer sides of both the ends of the splicing hole 2 are sufficiently entangled with each other, whereby a joint having a good shape free of horns can be formed.

On completion of the splicing operation, the clamping devices 35 and 38 release the yarn and the yarn pressing lever 8 and yarn handler lever 32 are retreated, and the yarn is allowed to leave the splicing apparatus.

As will be apparent from the foregoing description, the present invention is characterized in that the splicing operation in the splicing hole 2 is divided into the steps A and B, at the step A stirring of fibers is promoted by the jet stream from the nozzle opened toward the central portion of the splicing hole 2 to provide a sufficient strength for the joint, and at the step B not only the nozzle opened toward the central portion of the splicing hole 2 but also the nozzle opened in the tangential direction is operated to impose the action of the turning stream on the yarn ends, whereby a joint having a good shape free of horns can be obtained.

FIGS. 18 through 23 illustrate another embodiments of the present invention.

Figure 18:
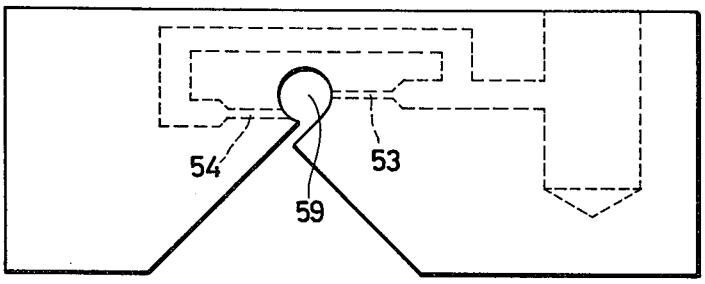
FIG. 18 is a plan view showing another embodiment of the splicing member.
Figure 19:
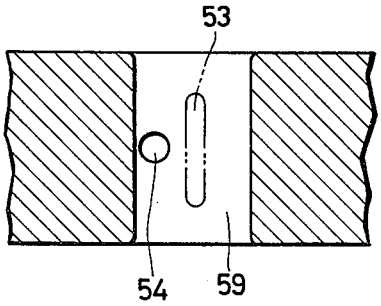
FIG. 19 is a diagram illustrating the sectional shape of the nozzle in the embodiment shown in FIG. 18.

In an embodiment illustrated in FIGS. 18 and 19, the section of a nozzle 53 opened to the center of a splicing hole 59 has a shape elongated in the axial direction of the splicing hole 59.

Figure 20:
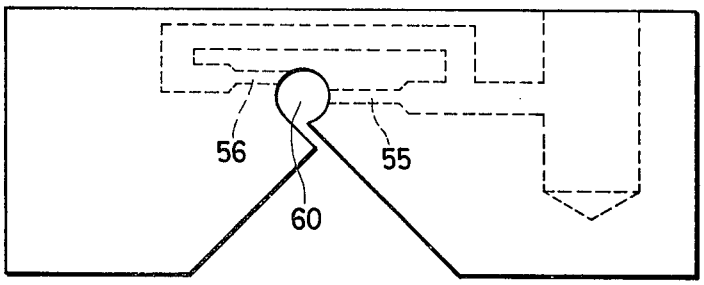
FIG. 20 is a plan view showing still another embodiment of the splicing member.
Figure 21:
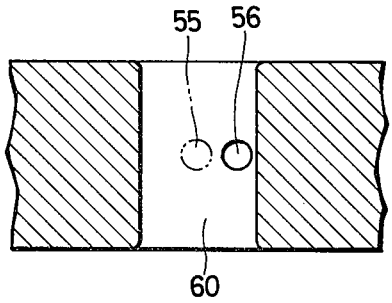
FIG. 21 is a diagram illustrating the sectional shape of the nozzle in the embodiment shown in FIG. 20.

In an embodiment illustrated in FIGS. 20 and 21, a nozzle 56 opened tangentially to a splicing hole 60 is located in the interior portion of the splicing hole 60 being away from the slit 3, and each of nozzles 55 and 56 has a circular section.

Figure 22:
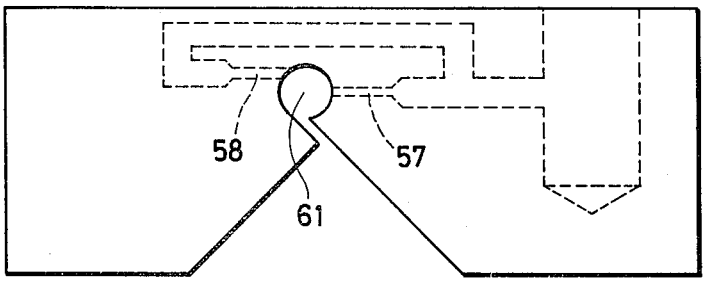
FIG. 22 is a plan view showing still another embodiment of the splicing member.
Figure 23:
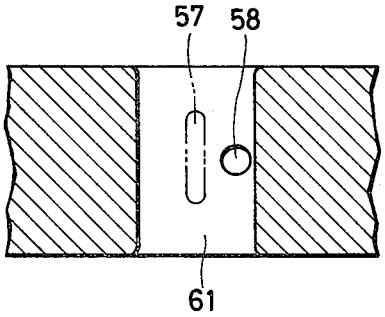
FIG. 23 is a diagram illustrating the sectional shape of the nozzle in the embodiment shown in FIG. 22.

In an embodiment illustrated in FIGS. 22 and 23, the section of a nozzle 57 opened to the center of a splicing hole 61 has a shape elongated in the axial direction of the splicing hole 61, and a nozzle 58 opened tangentially is located in the interior portion of the splicing hole 61.

Although a certain preferred embodiment has been shown and described, it should be understood that many changes and modification may be made therein without departing from the scope of the appended claims.

What is claimed is:

1. A pneumatic yarn splicing apparatus including a yarn splicing member, said yarn splicing member having opposed side faces and comprising a cylindrical splicing hole extending between the side faces, a slit extending along the full length of the splicing hole, a first nozzle being opened substantially toward the center of the splicing hole, and a second nozzle being tangentially opened to the splicing hole, wherein said first and second nozzles are communicated with a compressed air supply pipe through an air introduction hole and they are so arranged that the length of a passage extended from said air introduction hole to said second nozzle is longer than the length of a passage extended from said air introduction hole to said first nozzle so that there is produced a time lag between the initiation of jetting at the first nozzle and the initiation of jetting at the second nozzle.

2. A pneumatic yarn splicing apparatus as claimed in claim 1, wherein said first nozzle is opened on a wall of the splicing hole near to the junction of the slit with the splicing hole and said second nozzle is opened on the wall confronting to the first nozzle and being near the slit.

3. A pneumatic yarn splicing apparatus as claimed in claim 1, wherein said first nozzle is opened on a wall of the splicing hole near to the junction of the slit with the splicing hole and said second nozzle is opened on the wall confronting to the first nozzle and being away from the slit to be located in the interior portion of the splicing hole.

4. A pneumatic yarn splicing apparatus as claimed in claim 3, wherein said first and second nozzles have a circular section respectively.

5. A pneumatic yarn splicing apparatus as claimed in each one of claims 1, 2, 3 and 4, wherein said pneumatic yarn splicing apparatus further includes a pair of yarn presser levers, a pair of control nozzles, a pair of yarn guides, a pair of yarn cutters and a pair of fork guides which are disposed respectively on both sides of the yarn splicing member, and a pair of yarn handler levers fixed to upper and lower ends of a support shaft for pivotal movement therearound are positioned alongside of the yarn splicing member.

6. A pneumatic yarn splicing method comprising combination steps of guiding yarns into a yarn splicing apparatus;

introducing the yarns into a splicing hole of the yarn splicing apparatus and into yarn cutting devices provided on both sides of the splicing hole;

clamping and holding yarns by clamping devices disposed on outsides of the yarn cutting devices;

cutting yarn ends and sucking the cut yarn ends into control nozzles by actuating the control nozzles to suck them;

supplying compressed air jet toward the yarn ends to be loosened and untwisted;

drawing out the yarn ends from the control nozzle and setting them to be lapped in the interior portion of the splicing hole; and splicing the yarn ends by applying compressed air through the introduction hole of a compressed air supply pipe to said yarn ends, said splicing operation in the splicing hole being performed by two steps, at a first step stirring of fibers being promoted by the jet stream from a first nozzle opened toward the central portion of the splicing hole and at a second step being imposed under the action of the air stream by a jet stream from not only the first nozzle but also a second nozzle communicating with the air supply pipe and opened in the tangential direction to the splicing hole, such that the distance the jet stream travels between said air introduction hole and said second nozzle is longer than the distance the jet stream travels between said air introduction hole and said first nozzle and so that there is produced a time lag between the initiation of the jet stream at the first nozzle and the initiation of the jet stream at the second nozzle.

7. An apparatus for pneumatically splicing yarn comprising:

a splicing member having a body which has opposed side faces, the splicing member including:

a generally tubular channel extending between the opposed side faces;

a slit communicating with the channel and extending between the opposed side faces in a direction parallel to the channel;

an air introduction hole adjacent the channel and communicating with an air supply;

first and second air passages coupling the splicing channel to the air introduction hole, the first and second air passages being generally perpendicular to the channel, the first air passage guiding air towards the center of the splicing channel, the second air passage guiding air tangentially around the inside of the splicing channel, wherein the second air passage is longer than the first air passage, and wherein a time lag is produced between the introduction of air into the splicing channel from the first passage and the introduction of air into the splicing channel from the second passage.

8. A method for pneumatically splicing yarn comprising:

loosening and untwisting at least two yarn ends;

guiding the loosened and untwisted yarn ends into a splicing cavity of a yarn-splicing member;

passing air from an air supply source into a cavity in the yarn-splicing member, the cavity communicating with first and second passageways in the yarn-splicing member;

passing air from the cavity into and through the first passageway;

directing the air passing through said first passageway towards the center of the splicing cavity;

passing air from the cavity into and through the second passageway in the yarn-splicing member, the second passageway being longer than the first passageway; and directing the air passing through said second passageway tangentially around the splicing cavity, wherein there is produced a time lag between the initiation of air passing into the splicing cavity from the first passageway and the initiation of air passing into the splicing cavity from the second passageway.

* * * * *